United States Patent [19]

Spurgeon

[11] 4,312,541

[45] Jan. 26, 1982

[54] HARD ROCK TRENCH CUTTING MACHINE HAVING ANCHORING AND STEERING STRUCTURE

[75] Inventor: Weslin Spurgeon, Seattle, Wash.

[73] Assignee: Jarva, Inc., Solon, Ohio

[21] Appl. No.: 133,585

[22] Filed: Mar. 24, 1980

[51] Int. Cl.[3] ..... E21D 9/10

[52] U.S. Cl. ..... 299/31; 175/94; 175/76

[58] Field of Search ..... 299/31; 175/73, 76, 175/94

[56] References Cited

U.S. PATENT DOCUMENTS

| | | | |
|---|---|---|---|
| 2,925,258 | 2/1960 | Robbins | 299/31 |
| 3,840,271 | 10/1974 | Sugden | 299/31 |
| 3,957,310 | 5/1976 | Winberg et al. | 299/31 |
| 4,035,024 | 7/1977 | Fink | 299/31 |
| 4,189,186 | 2/1980 | Synder | 299/31 |

*Primary Examiner*—Ernest R. Purser

*Attorney, Agent, or Firm*—Pearne, Gordon, Sessions, McCoy & Granger

[57] ABSTRACT

There is disclosed a hard rock trench cutting machine comprising a main body assembly and a cutting wheel assembly. A cylinder is transversely mounted on the main body assembly and carries a pair of pistons which extend axially from each end of the cylinder. Pads are provided on each piston to bear against the sidewalls of a trench. Each piston has an end face within the cylinder which, together with an inner sidewall of the cylinder, comprises a pressure chamber adapted to force the pads against the trench. The main body and its cylinder are free to move laterally relative to the pistons when the cylinder is pressurized. Extensible arms are provided between the pistons and the main body assembly for forcing the main body assembly and its cutting wheel forwardly to progressively cut a trench. A steering assembly is provided to shift the main body assembly laterally relative to the pistons and about the central axis of the cutting wheel.

6 Claims, 9 Drawing Figures

HARD ROCK TRENCH CUTTING MACHINE HAVING ANCHORING AND STEERING STRUCTURE

BACKGROUND OF THE INVENTION

Trench cutting machines are used in a wide variety of environments and for a wide variety of purposes. One such environment is soft dirt or clay such as is frequently encountered in digging trenches for water lines or sewers or electrical lines which are buried a relatively short distance below the earth surface in a soft dirt or clay. In other environments, trenches must be cut in medium hard rock formations (i.e., formations having a compressive strength on the order of 6,000 to 12,000 psi, such as limestone and sandstone) and in extremely hard rock formations (i.e., formations having a compression strength of 25,000 psi minimum, such as diorite, granite, quartzite, or basalt).

The prior art has provided a variety of machines for cutting trenches. Certain of these prior art devices are shown in U.S. Pat. Nos. 3,219,390; 3,374,034; 3,472,555; and 3,148,917. A more recent U.S. Pat. No. 4,035,024 departs from prior art techniques of providing a hard rock trench cutting machine which is particularly well suited for use in underground mining when medium hard to extremely hard rock formations are encountered. In such mining, a vein of coal or ore which is mined may be of insufficient height to permit a mining railroad car to travel through the space which is left after the vein is mined. The hard rock trench cutting machine according to that invention is used to cut a trench through the hard rock at the bottom of the vein to provide a trench of sufficient depth to permit a mining railroad car to travel in the trench to permit removal of coal or ore from more remote locations in the vein.

A vein of coal or ore is seldom straight and any trench cutting machine must be designed with steering capability so that the operator may follow the vein. The hard rock cutting machine disclosed in U.S. Pat. No. 4,035,024 is capable of being steered by an adjustment of the hydraulic fluid in the clamping feet of the machine to thereby adjust the extension of the feet and the angle of attack on the hard rock. The operation is not particularly precise and is difficult to perform. A further drawback is that the hydraulic motors which power the cutting wheel must have a relatively short axial extent so as not to interfere with the tunnel roof. More powerful motors are available but their axial height prohibits their use in a trench cutting machine.

SUMMARY OF THE INVENTION

This invention overcomes many of the prior art problems by providing an easily steerable hard rock trench cutting machine with an improved drive. The machine includes a main body assembly and a cutting wheel rotatably mounted on the cutter wheel support assembly. Motors are mounted on the body assembly and drive the cutting wheel through gear transmissions. The cutting wheel has a polygonal sidewall which has cutting spokes mounted thereon so that upon rotation of the cutting wheel by its motors, the cutters scrape and crush the rock formations as the cutting wheel is advanced into the rock to thereby form a trench. A cylinder is mounted on the clamp carrier assembly transversely with respect to the longitudinal axis of the main body assembly, and has a pair of pistons mounted therein and extending in opposite directions to bear against opposed walls of the trench. The cylinder has a central pressure chamber which is shared by the pistons so that the main body assembly may shift relative to the pistons even though the pressure chamber of the cylinder is highly pressurized. A pair of steering arms are provided on the main body assembly and are employed to adjust angle of attack of the main body assembly by rotating the body assembly about the vertical axis of the clamp carrier.

The cutter wheel is attached to the main body assembly and is thrust forward by hydraulic cylinders which extend between the clamping feet and the main body assembly at an angle which ensures a forward force component on the cutting wheel. When the cutting machine is aimed or steered in a desired direction and with the clamping feet securely pressed against the trench walls, the thrust cylinders are actuated to move the main frame and cutting wheel forwardly to cut a portion of a trench. At the end of the stroke of the hydraulic cylinders, the clamping feet are retracted and the thrust cylinders are retracted to draw the clamping feet into another thrust producing position. During this operation, the cutting machine is supported by the cutter wheel support shoe and the retractable rear reset legs.

DETAILED DESCRIPTION OF THE INVENTION

Figure 1:
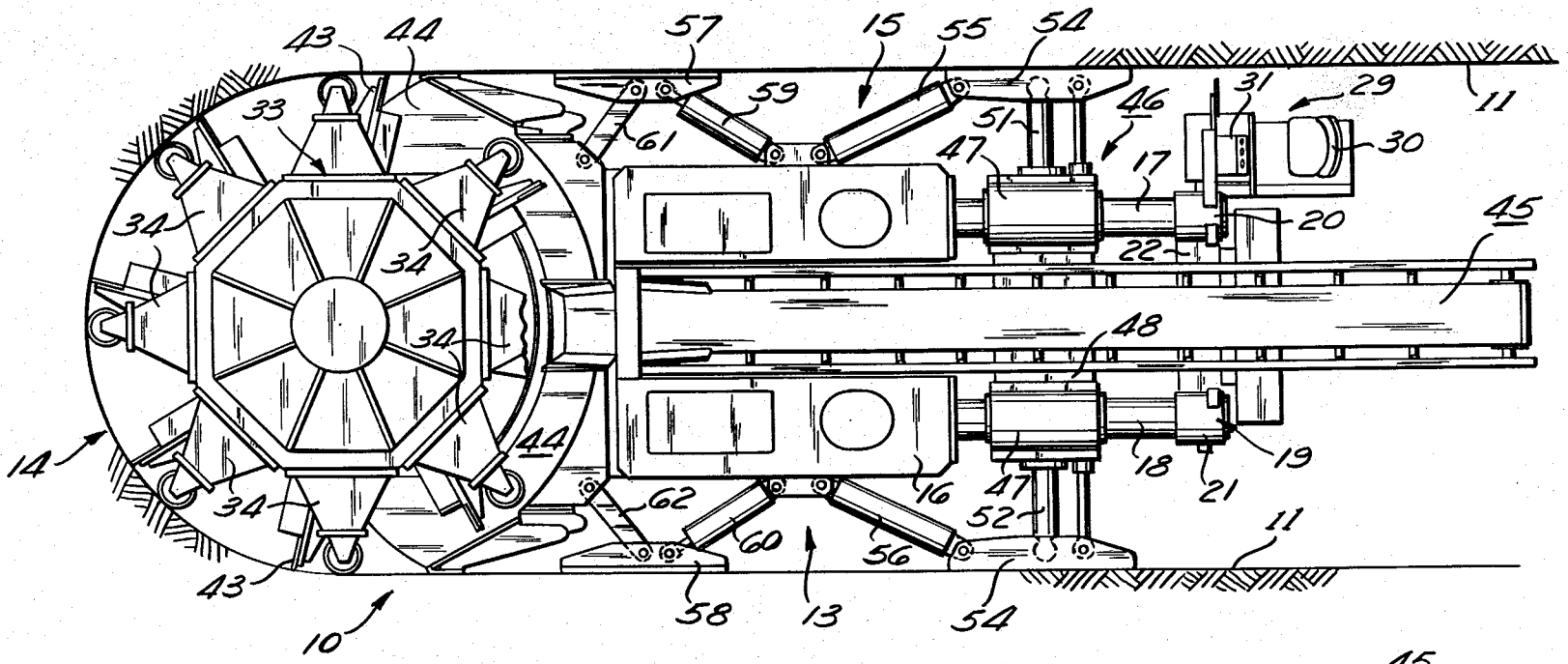
FIG. 1 is a top plan view of the trench cutting machine according to this invention.
Figure 2:
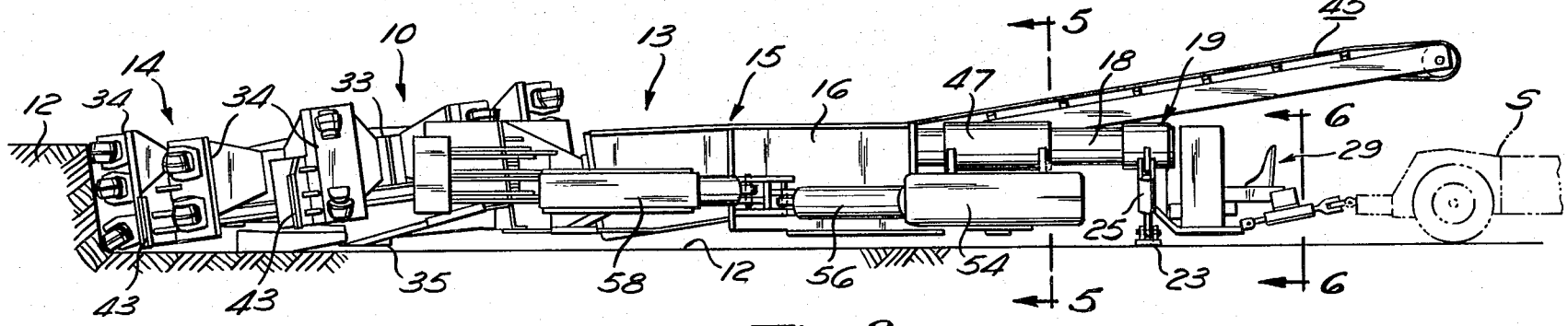
FIG. 2 is a side elevational view of the machine shown in FIG. 1.
Figure 3A:
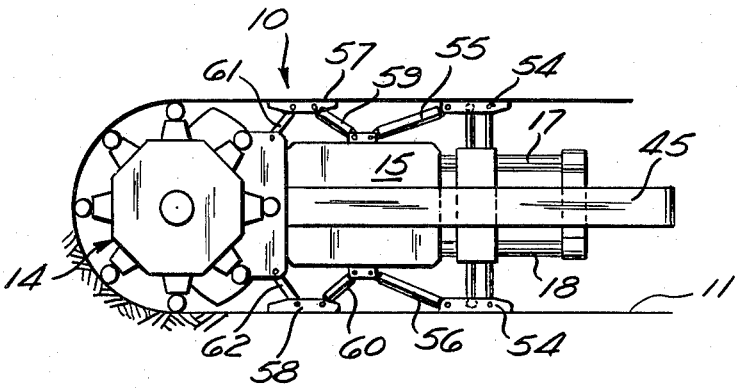
FIGS. 3*a*, 3*b*, and 3*c* are semi-schematic plan views showing the progressive stages of a steering operation.
Figure 3B:
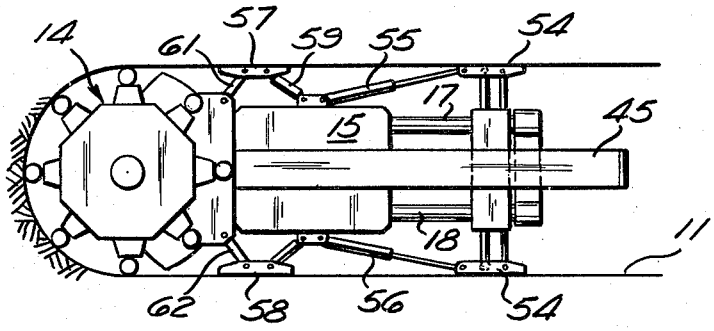
Figure 3C:
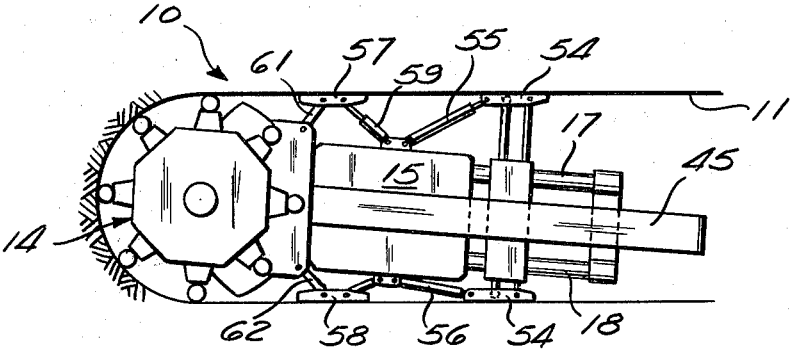
Figure 4:
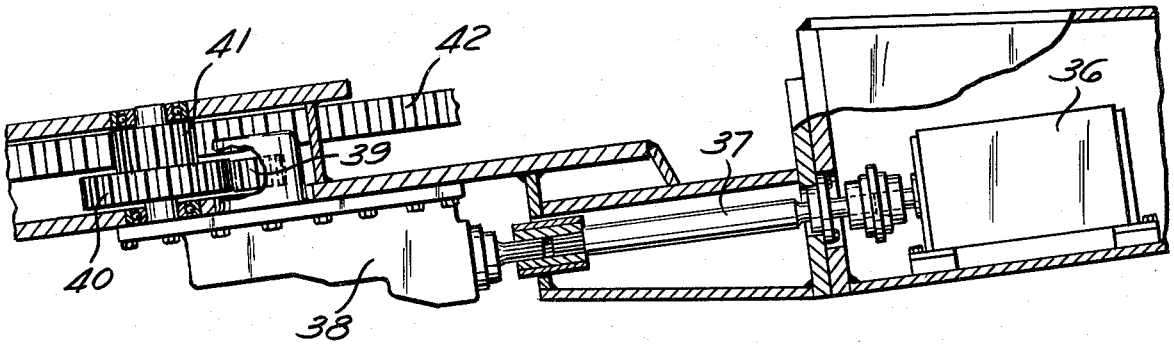
FIG. 4 is a cross sectional view of a portion of the main frame and the cutter wheel illustrating one of the drives for the cutter wheel.
Figure 5:
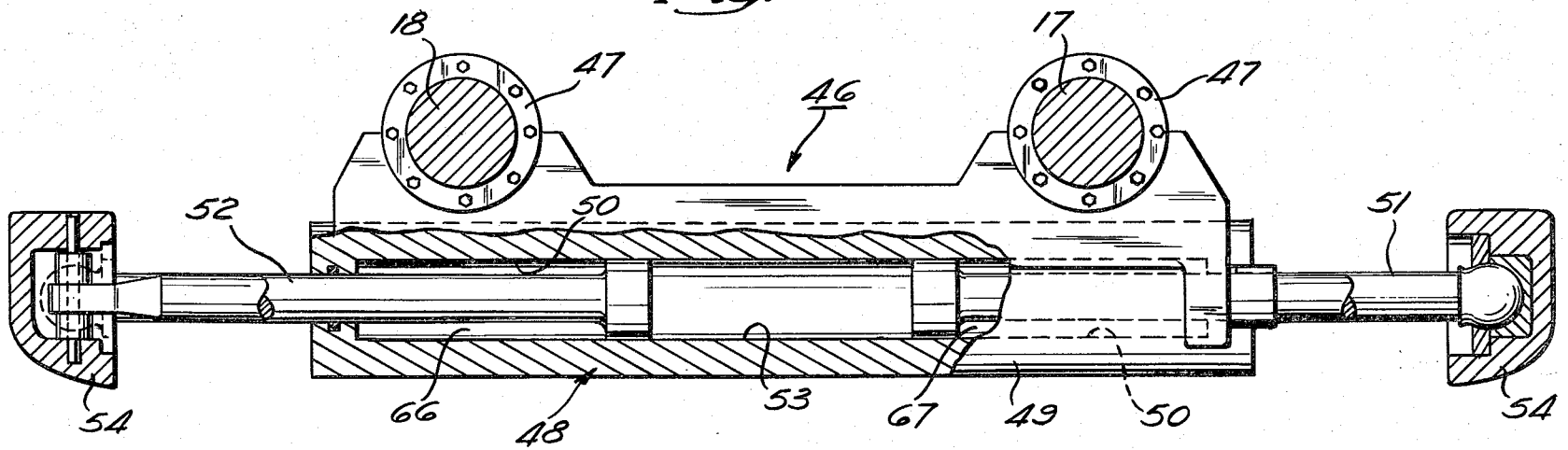
FIG. 5 is a cross sectional view of the machine, the plane of the section being indicated by the line 5—5 in FIG. 2.
Figure 6:
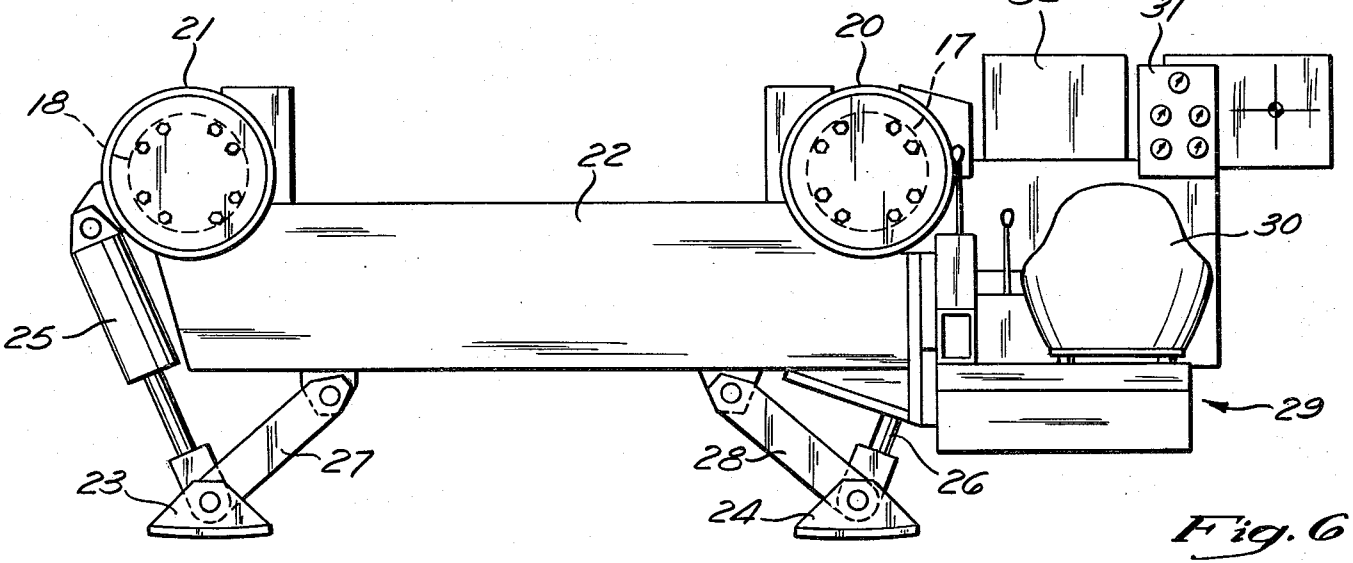
FIG. 6 is a rear elevational view of the machine, the direction of the view being indicated by the line 6—6 in FIG. 2.

Referring now to the drawings in greater detail, FIGS. 1 through 7 illustrate a hard rock trench cutting machine 10 cutting a trench 11 in a floor 12 of a mine. The cutting machine 10 includes a main body assembly 13, a cutter wheel assembly 14, and a longitudinal thrust assembly 15.

The main body assembly includes a main body 16 which has a pair of rearward projecting slide tubes 17 and 18 fixed thereto. The slide tubes terminate in a rear support assembly 19. The rear support assembly includes a pair of cylinders 20 and 21 which are tied together by a rear cross beam 22 (FIG. 6) and which are fixed to the slide tubes 17 and 18. A pair of support feet 23 and 24 are adjustably positioned under the rear of the machine by hydraulic cylinders 25 and 26 which are pivoted to the cylinders 20 and 21 and to the support feet 25 and 24. The support feet are also connected to the cross beam 22 by pivoted links 27 and 28. The rear support assembly further includes an operator's station 29 which includes an operator seat 30, a control panel 31, and an electrical cabinet 32.

The cutter wheel assembly 14 consists of an octagonal frame 33 having a number of cutting spokes 34 mounted thereon. The wheel is mounted by bearings (not shown) on a hydraulic cylinder 35 which adjustably supports the cutting wheel and the front of the machine during a cutting operation.

The cutting wheel is driven about its central bearing by motors 36 which are mounted in the main frame, as is indicated in FIG. 1. The motors 36 are coupled to drive shafts 37 which constitutes the input to a pair of transmissions 38. The output of each transmission is coupled to a pinion 39 and the pinion 39 drives a spur gear 40. The spur gear 40 is keyed to a pinion gear 41 which drives a ring gear 42 mounted within the cutter assembly. Since the motors 36 and the transmissions 38 are identical, only one is shown in detail. The cutter wheel is advanced into the face of the trench in a manner which will hereinafter be explained. As the cutters grind the rock at the trench face, the rock is scraped by scrapers 43 onto a muck ramp 44. The crushed rock is then pushed onto a conveyor 45 which conveys the rock to a shuttle car S which trails behind the cutter.

As was previously indicated, the cutting head is incrementally advanced to perform its cutting operation. To this end, there is provided a clamp carrier assembly 46 which is slidably mounted on the slide tubes 17 and 18. The clamp carrier assembly includes a pair of hollow tubes 47 which carry a hydraulic piston housing 48. The piston housing 48 carries a cylinder 49 which has a bore 50 therethrough and pressure legs 51 and 52 project from the bore 50 as pistons. The legs 51 and 52, together with the bore 50, constitute a common pressure chamber 53. With the pressure chamber 53 pressurized and with clamping feet 54 and 55 firmly locked in place by pressurization of the hydraulic chamber 53, the machine is driven forwardly by thrust cylinders 55 and 56, which extend from the feet 54 to the main frame 13 and which are pivotally connected to the feet and to the main frame. Extension of the thrust cylinders 55 and 56 forces the cutting head forwardly in the trench, since the entire main frame is extended and the slide tubes 17 and 18 slide in the tubes 47.

Steering is accomplished by a pair of steering feet 57 and 58 which are connected to the main frame assembly by steering cylinders 59 and 60. Steering links 61 and 62 are pivotally attached to the main frame assembly and to each steering foot 57 and 58. Thus, with the chamber 53 pressurized, the machine may be steered to the right or left by extending one of the steering feet 57 or 58 and by retracting the other foot a like extent and concomitantly extending one of the cylinders 55 or 56 and retracting the other. This action causes the main frame assembly to pivot about the axis of rotation of the cutter wheel while the legs 51 and 52 shift their angular relationship to the trench walls. When the desired angle of attack is achieved, the cylinders 55 and 56 are pressurized to begin a cutting stroke. During the cutting stroke, the steering arms are dragged along the walls while the rear reset legs are retracted. After the cylinders 55 and 56 have reached the end of their stroke, the rear reset legs are extended to support the rear of the machine, the chamber 53 is depressurized, the legs 51 and 52 are retracted, and the cylinders 55 and 56 are retracted to draw the clamp assembly to the position illustrated in the drawings.

Figure 7:
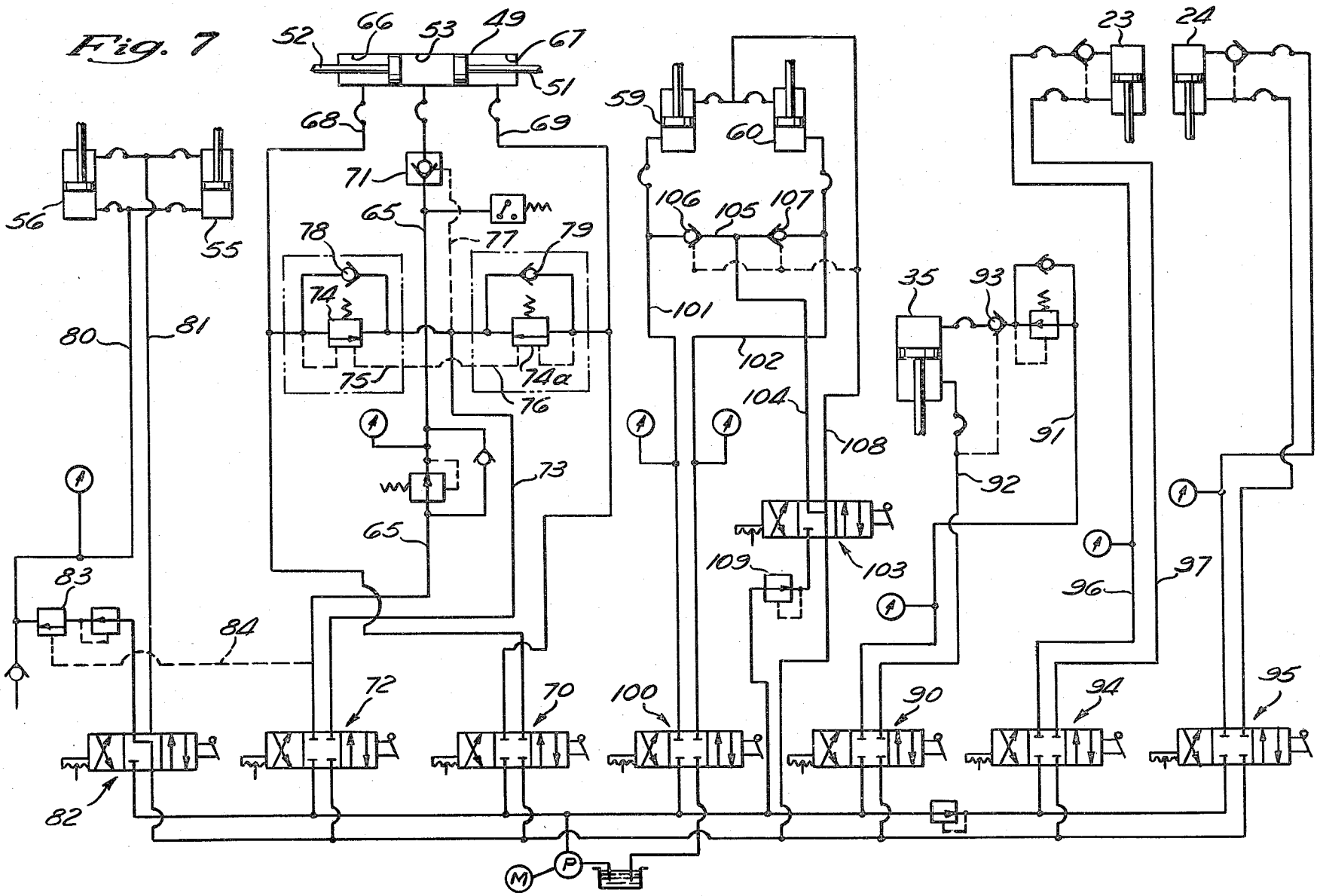
FIG. 7 is a schematic representation of the hydraulic control system for the machine.

To further understand the operation of the machine, reference may be had to FIG. 7, which illustrates the hydraulic circuitry involved in the previously described arrangement. In that figure, the cylinder 49 has its pressure chamber 53 connected to a line 65. Pressure chambers 66 and 67 outboard of the pressure chamber 53 are intended as an aid to the steering function and are connected to lines 68 and 69, respectively. In order to accommodate the steering function, a valve 70 is provided. The valve 70, when shifted to the right, connects the line 68 to the pump and connects the line 69 to drain so that the feet are shifted to the right as a unit, since fluid in the pressure chamber 53 is locked therein by a pilot-operated check valve 71. If the valve 70 is shifted to the left, the feet 51 and 52 would be shifted to the left. To provide for clamp pressure, a valve 72 is provided which controls fluid flow through the line 65 and through a line 73. To apply clamp pressure, the valve 72 is shifted to the left to connect the line 65 to the pump; and to connect line 73 to the sump, fluid flows past the one-way check valve and into the pressure chamber 53. At the same time, the chambers 66 and 67 are exhausted in the following manner. Pressure in the line 65 is applied to pilot-operated valves 74 and 74*a* through pilot lines 75 and 76, which opens the lines 68 and 69 to the line 73 which is connected to the sump. To retract the legs 51 and 52, the valve 72 is shifted to the right to connect the line 73 to the pump and to connect the line 65 to drain. Pressurizing the line opens the pilot-operated check valve through a pilot line 77, while the lines 68 and 69 are pressurized past check valves 78 and 79.

The thrust cylinders are extended by supplying fluid pressure to a line 80 and exhausting fluid through a line 81. This procedure is controlled by a valve 82. If the valve 82 is shifted to the left, fluid pressure is applied to the line 80 only if a pressure-responsive valve 83 is open. Opening of the valve may only occur if the pressure in the chamber 53 is about 3,000 psi, since this pressure is sensed by the valve through a pilot line 84. This feature is to ensure that the legs 51 and 52 are securely clamped prior to a thrust operation. As the thrust cylinders are extended, fluid is drained from the chambers ahead of the advancing pistons through the line 81, which is connected to the sump. To reset the thrust cylinders, the valve 82 is shifted to the right to connect the line 80 to the sump and to connect the line 81 to the pump.

The steering control for the trenching machine is controlled by a valve 100 which, when shifted to the left, connects to the cylinder 59 to the pump through a line 101. The cylinder 60 is exhausted to the sump through a line 102. When the desired steering has been accomplished, the valve 100 is centered and the cylinders are locked in place at a pressure of about 500 psi by a valve 103. This is accomplished by shifting the valve 103 to the left to connect a line 104 to the lines 101 and 102 through a line 105 and past pilot-operated one-way check valves 106 and 107. Fluid ahead of the pistons in the cylinders 59 and 60 is exhausted through a line 108. A pressure of 500 psi is maintained by a valve 109. To retract the steering cylinders, the valve 103 is shifted to the right to connect the line 108 to the pump and to open the pilot-operated check valve 106 and 107 so that the cylinders 59 and 60 may be exhausted through the check valve, the line 105, and the line 104 to the drain.

The cutting wheel support cylinder 35 is operated by a valve 90 which, when shifted to the left, connects a line 91 to the top of the cylinder to raise the cutting wheel, since a line 92 on the other side of the piston is connected to drain. The cutting wheel is lowered by shifting the valve 90 to the right to connect the lower portion of the cylinder to the pump and to connect the upper portion of the cylinder to drain through a pilot-operated, one-way check valve 93 which is opened by the pressure in the line 92.

The rear leg lift cylinders 23 and 24 are independently operated by valves 94 and 95, and since the operation of the cylinders is identical, only the operation of the cylinder 23 will be discussed. The cylinder is extended by shifting the valve 94 to the left to connect a line 96 to the pump to pressurize the upper half of the cylinder and to connect the lower half of the cylinder to the drain through a line 97. The piston is retracted by shifting the valve 94 to the right to connect the line 97 to the pump and to connect the line 96 to the drain.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A hard rock trench cutting machine for cutting a trench having an end face, two opposed sidewalls, a bottom wall, an open top, a longitudinal axis extending parallel to said sidewalls and to said bottom wall, and a lateral axis extending between said sidewalls perpendicular to said longitudinal axis and parallel to said bottom wall, said machine comprising a main body assembly and a cutter wheel and a longitudinal thrust assembly movable along said longitudinal axis with respect to said main body assembly and said cutter wheel, cylinder means on said longitudinal thrust assembly transversely mounted with respect to the longitudinal axis of said main body assembly, piston means extending axially from each end of said cylinder means and carrying means adapted to bear against opposed walls of the trench, each of said piston means having an end face within said cylinder means which, together with an inner sidewall of said cylinder, comprise a pressure chamber adapted to force said piston means against said opposed sidewalls, said main body assembly and said cylinder means being adapted to move laterally relative to said piston means with said pressure chamber pressurized, said cutter wheel being rotatably carried by said main body assembly for rotation about a rotational axis relative to said main body assembly, said rotational axis being substantially perpendicular to said lateral axis, a plurality of individual cutters mounted on said cutter wheel for engaging said trench end face, said individual cutters extending along said trench end face continuously from said bottom wall to said open top, rotational drive means rotating said cutter wheel about said rotational axis relative to said main body assembly, extensible means between said piston means and said main body assembly for forcing the main body assembly and said cutter wheel forwardly with respect to said longitudinal thrust assembly to progressively cut a trench, and steering means to shift said main body assembly laterally relative to said piston means and about said central axis.

2. A hard rock trench cutting machine according to claim 1, wherein said means to drive said cutting wheel about its central axis comprises a motor mounted in said main body assembly and a drive shaft extending between said motor and said cutting wheel and means between said drive shaft and said cutting wheel to rotate said wheel about its central axis.

3. A hard rock trench cutting machine according to claim 2, wherein said means to rotate comprises a pinion gear driven by said drive shaft and a ring gear fixed to said cutting wheel.

4. A hard rock trench cutting machine according to claim 1, wherein said extensible means between said piston means and said main body assembly are hydraulic cylinders and wherein said cylinders include valve means to actuate said cylinders only when the pressure in said pressure chamber reaches a predetermined value.

5. A hard rock trench cutting machine according to claim 1, wherein a retractable front support foot is provided on said cutting wheel and a rear retractable support foot is provided on said main body assembly to support said cutting wheel and main body assemblies after a cutting stroke so that said extensible means may be retracted to position said transversely mounted cylinder and its feet for a further cutting stroke.

6. A hard rock trench cutting machine according to claim 1, wherein said main body assembly includes a pair of tubes extending parallel to said longitudinal axis and said longitudinal thrust assembly is slidably journaled on said tubes.

* * * * *